United States Patent [19]

Allen

[11] 4,164,375

[45] Aug. 14, 1979

[54] IN-LINE MIXER

[75] Inventor: David J. Allen, Stockport, England

[73] Assignee: E. T. Oakes Limited, Macclesfield, England

[21] Appl. No.: 798,873

[22] Filed: May 20, 1977

[30] Foreign Application Priority Data

May 21, 1976 [GB] United Kingdom ..... 21210/76
Nov. 24, 1976 [GB] United Kingdom ..... 49007/76

[51] Int. Cl.[2] ..... B01F 5/06
[52] U.S. Cl. ..... 366/337; 261/DIG. 72
[58] Field of Search ..... 259/4 R, 4 A, 4 AB, 259/4 AC; 138/37, 38, 40, 42, 43; 261/DIG. 72, 79 A, 79 R; 48/180 R, 180 M; 123/141; 366/337

[56] References Cited

U.S. PATENT DOCUMENTS

| | | | |
|---|---|---|---|
| 3,266,524 | 8/1966 | Goettl | 138/37 |
| 3,557,830 | 1/1971 | Raw | 259/4 R X |
| 3,643,927 | 2/1972 | Crouch | 259/4 AB |
| 3,893,654 | 7/1975 | Miura et al. | 259/4 AB |
| 3,942,765 | 3/1976 | Henrickson | 259/4 R |

*Primary Examiner*—Philip R. Coe
*Attorney, Agent, or Firm*—Fleit & Jacobson

[57] ABSTRACT

An in-line mixer for mixing fluids pumped along a tube, being a number of mixing elements inserted in series longitudinally along a tube, each mixing element comprising a plate member folded along at least one fold line to form at least two substantially planar portions angled with respect to one another, at least one of the planar portions being of triangular shape having a base edge extending across the tube, substantially centrally thereof from one side to the other of the tube, the at least one fold line forming another side of said triangular portion.

15 Claims, 8 Drawing Figures

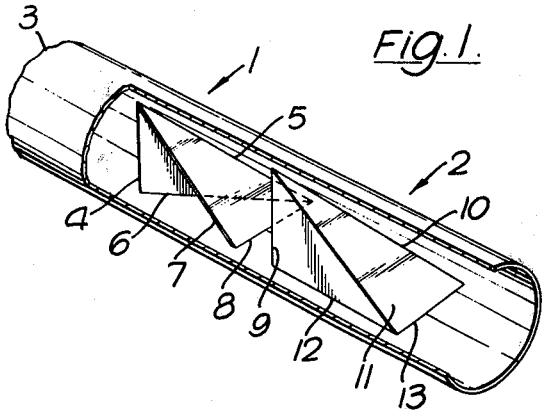
Fig. 1.
Fig. 2.
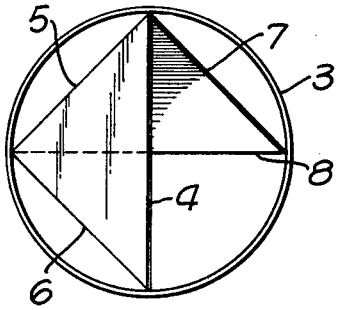
Fig. 3.
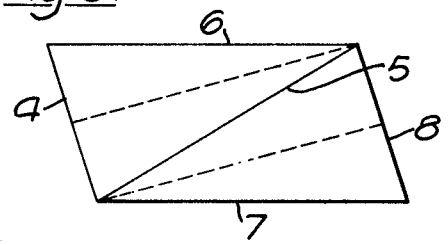

IN-LINE MIXER

The present invention relates to a mixer for the mixing of two or more fluids.

One form of mixer comprises a tube in which are mounted helical members arranged in series within the tube, alternate helical members being of left-hand and right-hand form. The fluids to be mixed are pumped through the tube and are divided into two channels of substantially the same cross-sectional area by the first member and are turned through an angle which is usually 90° or 180° before meeting the second helical member whereupon the two streams are each divided to produce four streams, the four streams divided to produce eight and so on. The alternate left and right-hand pitch of the helical members ensures a thorough mixing operation. However, the construction of such helical members poses a number of problems, thereby making the manufacture of such members relatively expensive.

According to the present invention we provide an in-line mixer comprising a tube, a plurality of mixing elements positioned in series longitudinally along the tube, each mixing element comprising a plate member folded along at least one fold line to form at least two substantially planar portions angled with respect to one another, at least one of the planar portions being of triangular shape having a base edge extending across the tube, substantially centrally thereof from one side to the other of the tube, the at least one fold line forming another side of said triangular portion.

Thus the mixing elements of the invention can be manufactured more easily than the element of prior mixers, since it may be constructed simply by the folding of a plate along at least one fold line as described.

In one embodiment, a plurality of mixing elements are positioned in series longitudinally along the tube, each mixing element being a plate member having at least four edges and folded about a line extending between two opposite corners of the plate, to form two substantially planar portions angled with respect to one another, the leading edge of one element being arranged at an angle to the trailing edge of the adjacent element upstream thereof.

Although it is primarily intended that the edges of the plate should all be straight, it is also contemplated that at least some of them may be curvilinear so that they lie close to the inner wall of the tube.

In a preferred construction, the edges of the plate are straight, such that the plate member is in the form of a parallelogram, and when folded produces two planar portions of triangular shape. Advantageously, the triangles produced by the folding of the parallelogram are isosceles triangles, the line of fold being the shorter diagonal of the parallelogram, and the planes of the element being inclined perpendicular to one another.

When the two planar portions of the mixing element form isosceles triangles, the element is positioned within the tube so that the leading edge abuts the inner walls of the tube and lies in a plane transverse to the axis of the tube, while the trailing edge of the element lies in a plane parallel to that of the leading edge and extends in a direction at an angle, preferably perpendicular to that of the leading edge.

The element of this embodiment can produce a better mixing effect than of the conventional helical members described above. Material approaching the mixing element mounted in the tube will be divided into two channels by the leading edge of the element and continue along the tube passing over opposite sides of the same triangular portion.

As one surface of the portion is inclined towards and is in contact at each apex with the inner wall, the material is divided a second time as it rolls off the two lateral edges of the portion, this action producing a turbulent effect, especially within fluids of low viscosity. The material in the other channel encounters the second triangular portion and experiences a similar turbulent effect as that of the first channel. In this way the element provides a greater degree of mixing within the material by dividing it twice and also producing turbulence within itself.

The elements are positioned in the tube such that alternate ones are of left-hand and right-hand form, and moreover the leading edge of one element is positioned at an angle to the trailing edge of the element upstream, thereby ensuring that each element cuts the material at a different angle from the previous element and provides a greater mixing effect.

A ring member may be mounted between adjacent mixing elements against the tube wall so that the fluid will be pulled away from the tube wall thereby ensuring a higher degree of mixing. In the case of the tube being cylindrical, the ring member may have a cylindrical outer surface which abuts the inner wall of the tube, and an inner frusto-conical surface which tends to direct the fluid from the outer wall towards the axis of the tube. Such ring members may be positioned alternately with the mixing elements, or may be positioned between, say, every second, third or fourth mixing element.

Adjacent elements and ring members may be connected to one another within the tube in a number os ways; they may be joined by edge-contact, by rods extending along the axis of the tube from one element to another or by spacers which may comprise an annulus (in the case of a cylindrical tube) which abuts the inner wall of the tube. Alternatively, the elements and ring members may be secured in position relative to one another by the provision of a notch or notches. The notch or notches may be provided in the elements or members themselves, so that two elements or members overlap one another, or may be provided in one element and in the end portion of one or more intermediate elements or just in the end portion of such intermediate element or elements. It may be desirable to chamfer the trailing and leading edges of adjacent elements. If desired, the elements and spacers may be welded.

Another embodiment of mixer according to the present invention, has a plurality of elements of a first and second type arranged sequentially therein along the length thereof, each element including two members comprising a flat triangular central portion having a base edge and two side edges, and two flat side flaps, extending one from each side edge, the flaps of the two members of an element of the first type being turned in one rotational sense relative to the central portion, as viewed from the base edge thereof, and the flap of the two members of the element of the other type both being turned in the opposite sense, the flaps having a free edge and an edge engaging the inner wall of the tube along their full length, the free edges of the flaps of one member of an element being contiguous with the base edge of the triangular central portion of the other member of the element, so that the leading and trailing edges of an element are formed by the two free edges of the flaps of one member and the base edge of the other member, the leading edge of one element being angled to the trailing edge of the adjacent element.

The members for making up the elements of such a device can readily be made from flat metal or similar stock, by stamping out and folding the flaps relative to the triangular base portions.

The disposition of the flaps is such that they will effectively tend to urge material close to the walls of the tube into the centre by wedging action. Thus the mixing device of the present invention is particularly suitable for mixing viscous fluids.

If the tube is of circular cross-section, as is preferred, the edges of the flaps engaging the inner wall of the tube will themselves be of arcuate form. Preferably the triangular central portion is an isosceles triangle, the flaps being turned up or down from one of the equal sides. Advantageously, the triangle is nearly equilateral although a particularly advantageous construction is one in which the apex angle is 65°.

The effect of providing the members of an element in the manner indicated is to produce a rotational swirl of either clockwise or anticlockwise rotational sense of the fluid flowing through the tube. Preferably alternate elements are of a first and second type to provide alternate clockwise and anticlockwise swirls. However, it is also contemplated that a plurality of first type of elements can be arranged sequentially followed by a plurality of second type of elements.

In an advantageous construction, the leading edge of one element is arranged perpendicular to the trailing edge of the adjacent element upstream thereof. However, other angles are contemplated.

The trailing edge of one element could be in direct contact, that is at the same axial position as the leading edge of the next element. Alternatively, by providing notches in the ends of the elements, the two elements could overlap one another. Similarly by providing spacers in the form of rings or central rods, the leading and trailing edges of adjacent elements could be axially spaced with respect to one another.

In order that the invention may more readily be understood, the following description is given, merely by way of example, reference being made to the accompanying drawings, in which:-

FIG. 1 is a perspective view of two adjacent mixing elements of one embodiment of mixer according to the invention mounted within a tube;

FIG. 2 is a view along the axis of the tube of the leading element of FIG. 1 mounted within the tube;

FIG. 3 is a plan view of the element before folding;

Figure 4:
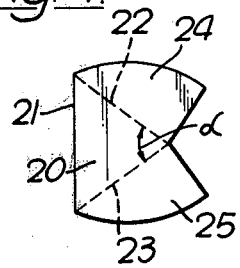
FIG. 4 is a plan view of a blank from which the elements of the device of the present invention are formed.

FIG. 1 shows a mixing element, generally designated as 1, mounted within a cylindrical tube 3 such that the ends of the leading edge 4 abut the inner walls of the tube 3. Element 1 has three lateral edges 5, 6, 7 and a trailing edge 8, whose ends also abut the inner walls of tube 3.

Downstream and adjacent to element 1 is another element, generally designated as 2, which is of the opposite form to that of element 1. Element 2 has a leading edge 9, which is perpendicular to trailing edge 8, lateral edges 10, 11 and 12 and trailing edge 13. The ends of both leading edge 9 and trailing edge 13 abut the inner walls of tube 3.

FIG. 2 shows element 1 as viewed from a point upstream along the axis of tube 3; in FIG. 3 the element 1 is shown before folding occurs. Element 1 is in the shape of a parallelogram such that, when folded along its shorter diagonal (i.e. the line represented by edge 5), it forms two isosceles triangles joined along one common side, the triangles being positioned such that the apex of each triangle forms one end of the base line of the other. In a special case of this embodiment, each triangle may be equilateral, such that all edges (i.e. 4, 5, 6, 7 and 8) are equal in length.

Although only two elements have been shown, in practice a number of elements are mounted in series along the tube to provide good mixing of the material. Moreover, a ring member may be positioned in between some elements to prevent material from clinging to the inner walls of the tube by channeling it towards the axis of the tube.

In operation, material to be mixed is made to pass along the tube and encounters the leading edge 4 of element 1, which splits it into two channels. One channel of material moves along the surface of the first triangular portion of element 1 to the left of leading edge 4, and is made to move in a vertical as well as a horizontal direction by the inclination of this surface towards the inner wall of tube 3.

In this way, the material is made to roll over the lateral sides 5 and 6 of element 1, this action producing turbulence within the material, especially when it is of low viscosity. The material in the other channel moves along the surface of the first triangular portion to the right of leading edge 4, and is forced downwards by the second triangular portion thereby, causing the material to roll over lateral edges 6 and 7 and trailing edge 8 and producing more turbulence. Both channels of material are thus further divided by the triangular portions of element 1, the left-hand channel having two sections, and the right-hand channel having three sections.

Element 2 is orientated with respect to element 1 such that the leading edge 9 will cut the material at an angle to that produced by leading edge 4, so that a greater mixing effect will be produced. The flow of the material about element 2 will be similar to that over element 1, except that it is the left-hand channel produced by leading edge 9 that is split up into three sections and made to roll over lateral edges 10 and 12 and trailing edge 13.

With regard to the construction illustrated in FIGS. 4 to 8, there is illustrated in FIG. 4, a blank including a flat triangular portion 20 having a base edge 21 and two side edges 22 and 23. Flat flap portions 24 and 25 are connected to the base portion at these edges 22 and 23, the angle $\alpha$ at the apex of the triangular portion being approximately 65°.

Figure 5:
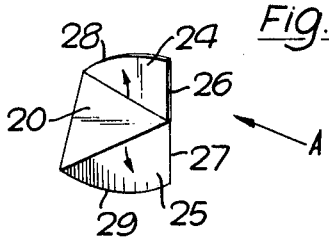
FIG. 5 is a perspective view showing the elements made up to provide clockwise swirl as viewed in the direction of the arrow A.
Figure 6:
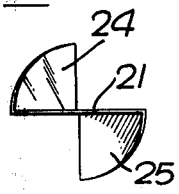
FIG. 6 is a view of the element of FIG. 5 in the direction of the arrow A.
Figure 7:
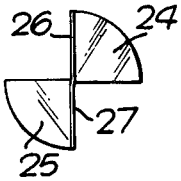
FIG. 7 is a view from the opposite direction.

Referring to FIG. 5 it will be seen that the flap portion 24 has been turned up to form flaps 24 and 25 so that the flaps have been turned, as viewed from the base of the triangle in a direction opposite to the arrow A, in a clockwise sense. The flaps 24 and 25 each have a free edge 26 and 27 respectively and an elliptical form edge 28 and 29 respectively.

Figure 8:
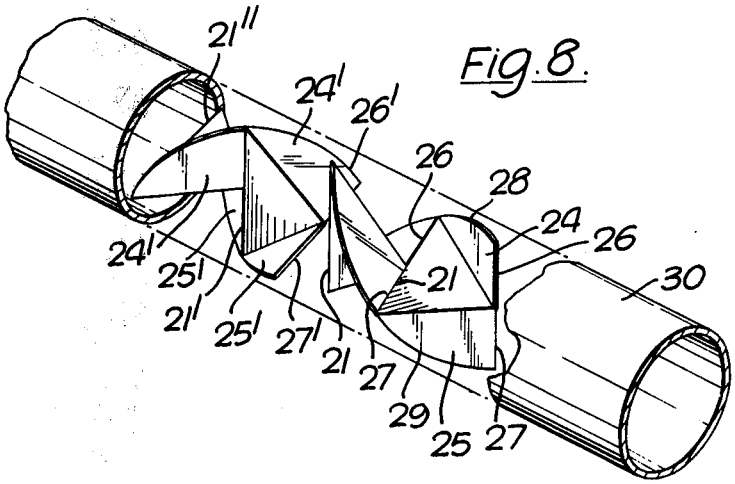
FIG. 8 is a schematic perspective view of one embodiment of mixer according to the invention with elements of the type illustrated in FIGS. 5, 6, and 7 formed into members, these members alternating with members of the other type.

Referring to FIG. 8 the members so far described have been mounted in pairs in a circular cross-section tube 30. Thus the member as shown in FIG. 5 is arranged with a substantially identical member which has been turned through 90°, so that the free edges 26 and 27 of its flap are contiguous with the base edge 21 of the central triangular portion of the first member shown on the right in the drawing. Thus the corresponding edge 21 of the second of these two members of this type is parallel to the leading edge of the thus formed element formed by the free edges 26 and 27. The contiguous edges of the two members which thus form an element are secured together, e.g. by welding or soldering.

Mounted next to this thus formed element is a second element having members which have been made by bending the flaps 24' and 25' in the opposite sense relative to the triangular central portion. Thus, as viewed from the base edge 21', these flaps have been turned in an anticlockwise sense so the flap indicated by the reference numeral 24' in the FIG. 8 is bent down to the left and the flap indicated by the reference numeral 25' is bent up to the right. As before, a similarly bent member is arranged so that the free edges of the flaps 24', 25' are contiguous with the base edge 21'.

As can be seen from the drawing, the leading edge of the second element which is formed by the base edge 26' and 27' of the second element is substantially perpendicular to the trailing edge of the first element which is formed by the base edge 21, and is substantially parallel to the trailing edge 21'' of the second member. A fluid flowing through the tube will be divided by the leading edge of the first element, formed by the free edges 26 and 27, the fluid at the bottom being pushed to the left and upwardly, and the fluid at the top being pushed to the right and downwardly by the effect of the flaps of the first element, thus giving rise to a clockwise rotational sense. The fluid, which will by this time have been divided into two streams through this righthand rotational sense, will then be confronted by the leading edge of the second element which will tend to have the reverse effect, that is to say it will cause the fluid to execute an anticlockwise rotation.

As indicated previously, the members can be arranged to produce alternate clockwise and anticlockwise swirl or can be arranged to produce a number of clockwise swirls followed by a number of anticlockwise swirls.

Furthermore, although in the preferred construction illustrated the leading edge of each element, is formed by the free edges of the flaps of that element, the leading edge of one element could be so formed and the leading edge of the next element could be formed by the base edge of the triangular central portion and so on. It is equally possible to use the base edges of all the triangles as the leading edges of some or all of the elements if so desired.

I claim:

1. An in-line mixer comprising a tube, a plurality of mixing elements arranged in series longitudinally along said tube, each mixing element comprising a one piece plate member having four edges meeting in four corners, said plate being folded along a fold line extending between two opposite corners of the plate, to form two substantially planar triangular shaped portions angled with respect to one another, the triangular shape being defined by a base edge, an edge formed by said fold line and a free edge, the base edge extending across the tube, substantially centrally thereof from one side to the other of the tube.

2. A mixer according to claim 1, wherein the edges of the plate member are straight, such that the plate member is in the form of a parallelogram.

3. A mixer according to claim 2, wherein the triangles produced by folding the parallelogram are isosceles triangles, the line of fold being the shorter diagonal of the parallelogram, and the planes of the element being inclined perpendicular to one another.

4. A mixer according to claim 1, wherein the leading edge of one element is positioned at an angle to the trailing edge of the element upstream thereof.

5. A mixer according to claim 1, wherein the elements are positioned in the tube such that alternate ones have their fold line bent in the opposite sense so that alternate elements are of left and righthand form.

6. An in-line mixer comprising a tube, a plurality of mixing elements positioned in series longitudinally along said tube, said mixing elements being of a first and a second type arranged sequentially in the tube along the length thereof, two members being included in each element, said two members comprising a flat triangular central portion, having a base edge and two side edges and two flat side flaps, extending one from each side edge, the flaps of the two members of an element of the first type being turned in one rotational sense relative to the central portion, as viewed from the base edge thereof, and the flaps of the two members of the other element of the other type both being turned in the opposite sense, a free edge and an edge engaging the inner wall of the tube along the full length of said flaps, the free edges of the flaps of one member of an element being contiguous with the base edge of the triangular central portion of the other member of the element, so that the leading and trailing edges of an element are formed by the two free edges of the flaps of one member and the base edge of the other member, the leading edge of one element being angled to the trailing edge of the adjacent element, the base edges all extending across the tube, substantially centrally thereof from one side to the other of the tube.

7. A mixer according to claim 6, wherein the tube is of circular cross-section, and the edges of the flaps engaging the inner wall of the tube are of arcuate form.

8. A mixer according to claim 6, wherein the triangular central portion is an isosceles triangular, flaps being turned up or down from one of the equal sides of the isosceles triangle.

9. A mixer according to claim 8, wherein the triangles have an apex angle of approximately 65°.

10. A mixer according to claim 6, having a first and a second type element, said first and second type elements being positioned alternately along the tube to provide alternate clockwise and anticlockwise swirling motion of fluid being mixed.

11. A mixer according to claim 6, wherein a plurality of the first type of element are arranged sequentially with a plurality of a second type of element.

12. A mixer according to claim 6, wherein the leading edge of one element is arranged at an angle with the trailing edge of the adjacent member upstream thereof.

13. A mixer according to claim 12, wherein the leading edge of one element is arranged perpendicular to the trailing edge of the adjacent element upstream thereof.

14. A mixer according to claim 6, wherein the trailing edge of one element is in direct contact and at the same axial position as the leading edge of the next element.

15. A mixer according to claim 1, wherein the elements are formed from flat metal stock.

* * * * *